US005755354A

United States Patent [19]

Lang

[11] Patent Number: 5,755,354

[45] Date of Patent: May 26, 1998

[54] BEVERAGE CAN

[75] Inventor: Wolfgang Lang, Schwäbisch Gmünd, Germany

[73] Assignee: Engelbrauerei Schwaebisch Gmuend, Luise Lang GmbH & Co. KG, Schwaebisch Gmuend, Germany

[21] Appl. No.: 597,487

[22] Filed: Feb. 2, 1996

[51] Int. Cl.[6] ..... B65D 1/12

[52] U.S. Cl. ..... 220/689; 220/703; 220/906; 215/41

[58] Field of Search ..... 220/681, 689, 220/658, 703, 906, 619, 614; 215/41, 42, 324

[56] References Cited

U.S. PATENT DOCUMENTS

| | | | |
|---|---|---|---|
| 1,855,813 | 4/1932 | Zampari | 220/619 |
| 2,117,180 | 5/1938 | Kronquest | 220/906 |
| 2,426,550 | 8/1947 | Coyle | 220/906 |
| 2,547,059 | 4/1951 | Taylor et al. | 220/906 |
| 2,895,654 | 7/1959 | Rieke . | |
| 4,313,545 | 2/1982 | Maeda | 220/906 |
| 4,452,368 | 6/1984 | Roth | 220/906 |
| 4,573,615 | 3/1986 | Marti . | |

FOREIGN PATENT DOCUMENTS

| | | | |
|---|---|---|---|
| 3 59 816 | 12/1980 | Austria . | |
| 633681 | 2/1928 | France | 220/906 |
| 799649 | 6/1936 | France | 220/906 |
| 537556 | 8/1956 | Germany | 215/45 |
| 19 59 758 | 11/1969 | Germany . | |
| 3504427 | 8/1986 | Germany . | |
| 3926820 | 2/1990 | Germany . | |
| 3841159 | 6/1990 | Germany . | |
| 617 107 | 5/1980 | Switzerland . | |
| 9 29 992 | 6/1963 | United Kingdom . | |

*Primary Examiner*—Stephen J. Castellano
*Attorney, Agent, or Firm*—Flynn, Thiel, Boutell & Tanis, P.C.

[57] ABSTRACT

A metal beverage can with a cup portion (10) closed at the bottom and open at the lid, and a lid portion (20) has a closable pouring opening (18) and is flanged with a flanged edge (12) onto a lid-facing edge (16) of the cup portion with a gasket (14) clamped between said flanged edge and the lid-facing edge. The lid portion (20) has, according to the invention, a pouring dome (24) connected on the inside through a circular drop-catching trough (22) to the flanged edge (12), and is curved convexly upwardly beyond the upper edge of the flanged edge, and the pouring dome has an axially centrally upwardly projecting essentially cylindrical pouring connection (26) having the pouring opening (18).

13 Claims, 3 Drawing Sheets

BEVERAGE CAN

FIELD OF THE INVENTION

The invention relates to a metal beverage can including a cup portion closed at the bottom and a pouring connection having a closable pouring opening.

BACKGROUND OF THE INVENTION

Beverage cans of this type have mostly a flat or slightly curved lid plate under the flanged upper edge on their lid portion, a pouring opening being integrated into the plane of the lid plate. The pouring opening is closed for transport and storage purposes by a break-out seal which is connected to the lid plate along a desired rupture line and can be broken open with a lever member riveted thereon toward the inside of the can releasing the pouring opening from the lid plate. The content of the can is poured out over the elevated flanged edge such that a drop formation on the outside of the flanged edge and a running off of the drops over the outer surface of the can cannot be avoided. Hygienic concerns exist with respect to the pouring over the free flanged edge and with respect to the lid closure being swung into the inside of the can. In addition, once the beverage can has been opened, it can no longer be closed again so that storing of the unused content and reuse of the can in a multi-use system is not possible.

Starting out from this, the basic purpose of the invention is to develop a beverage can from a metal plate having a hygienically usable pouring area and which even after opening is conducive to reuse and multiple use.

To attain this purpose the characteristic combinations disclosed in claims 1, 4 and 11 are suggested. Advantageous embodiments and further developments of the invention result from the subclaims.

SUMMARY OF THE INVENTION

The solution of the invention is based on the thought that during pouring through the pouring opening, the beverage no longer comes into contact with can parts exposed during transport and storage and are thus nonhygienic. Furthermore, the solution assures that possible drops forming at the opening edge of the pouring opening cannot run off over the outer surface of the can. In order to achieve this, the invention prescribes that the metal plate of the pouring connection be flanged at its upper edge defining the pouring opening from the outside inwardly at approximately 180° forming a circular, widened pouring edge and a trough circularly open toward the inside of the cup, and that the free trough edge pointing toward the inside of the cup has at least one coined drip release notch reaching into the vicinity of the upper edge of the pouring edge. The sharp edge of the metal plate points thus toward the inside of the cup and does not present any health risk when drinking out of the can. On the other hand, the circular opening in the trough pointing to the inside of the cup assures, during cleaning and rinsing operations that rinsing liquid can penetrate into the trough and can again escape from said trough during the subsequent turning of the can. A pocket formation in the area of the trough, where bacteria could accumulate is thus avoided. The drip release notch assures that no water remains in the mentioned trough during the cleaning operation.

In order to be able to close off the pouring opening with a crown cork, it is advantageous when the pouring connection is slightly constricted below the pouring opening forming a circularly undercut pouring edge, which is arcuate in cross section and almost a closed circular configuration. In addition, the pouring connection can have a peripheral groove axially spaced from the pouring edge for example in the area of which peripheral groove, an edge-open support ring with diametrically opposed bearing openings for a snap closure can be releasably locked onto the pouring connection. Thus, the above-disclosed inventive measures make it possible, in their combination, so that the pouring opening can be closed off selectively with a crown cork for storing and transporting purposes and with a snap closure for storing a left-over beverage or for the further use of the can.

The cup portion is advantageously manufactured of an aluminum slug in an extrusion method. Also, the manufacture of the cup portion in a deep-drawing method is conceivable. Whereas the lid portion is advantageously constructed as a step-drawn molded part of aluminum, from which the pouring opening and the drip stamping is stamped and is flanged forming the widened pouring edge. Both the cup portion and also the lid portion have a plastic coating on the inside, which plastic coating does not interfere with the beverage.

In order to guarantee a good stability of the beverage can independent from its inner pressure, the cup portion has advantageously a base curved inwardly from the cup edge.

BRIEF DESCRIPTION OF THE DRAWINGS

The invention will be described in greater detail hereinafter in connection with one exemplary embodiment schematically illustrated in the drawings, in which.

DETAILED DESCRIPTION

Figure 1:
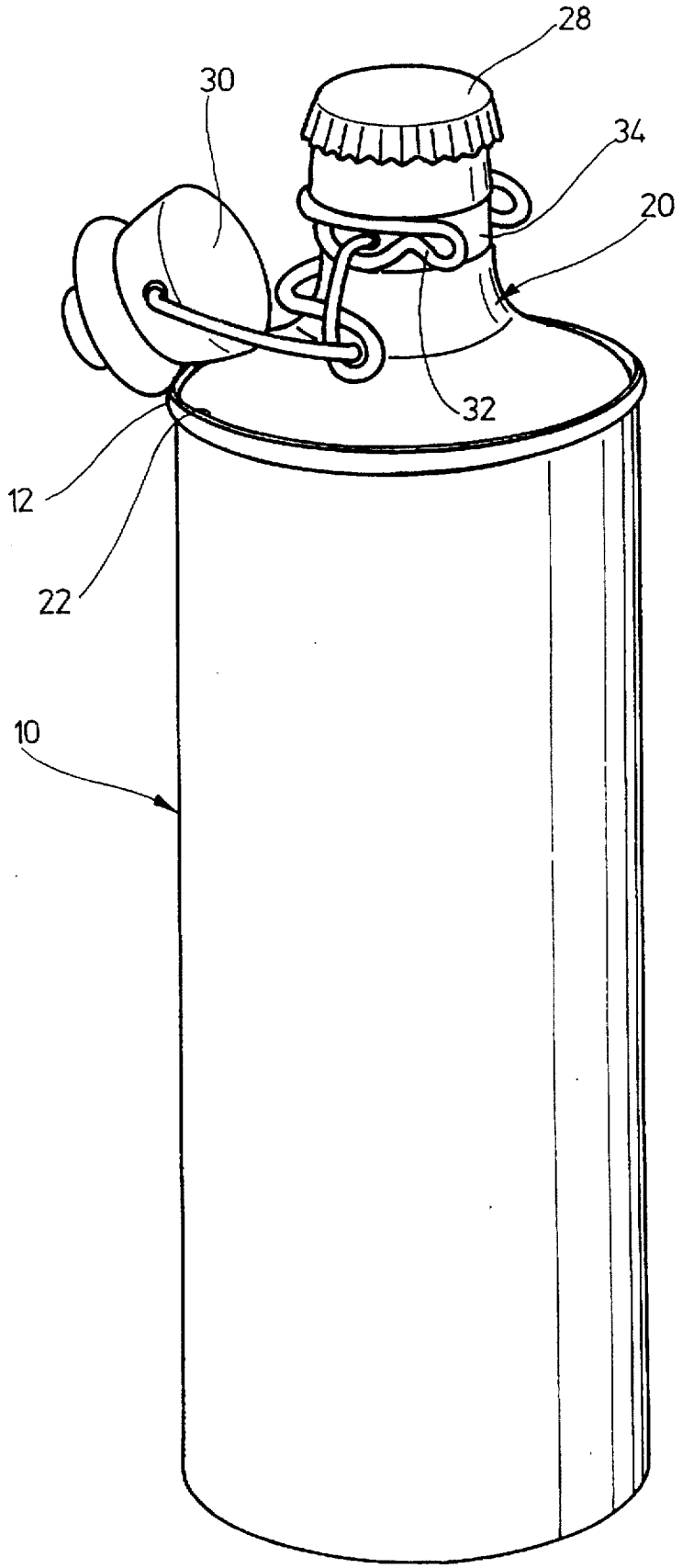
FIG. 1 is a diagrammatic illustration of a beverage can.
Figure 2:
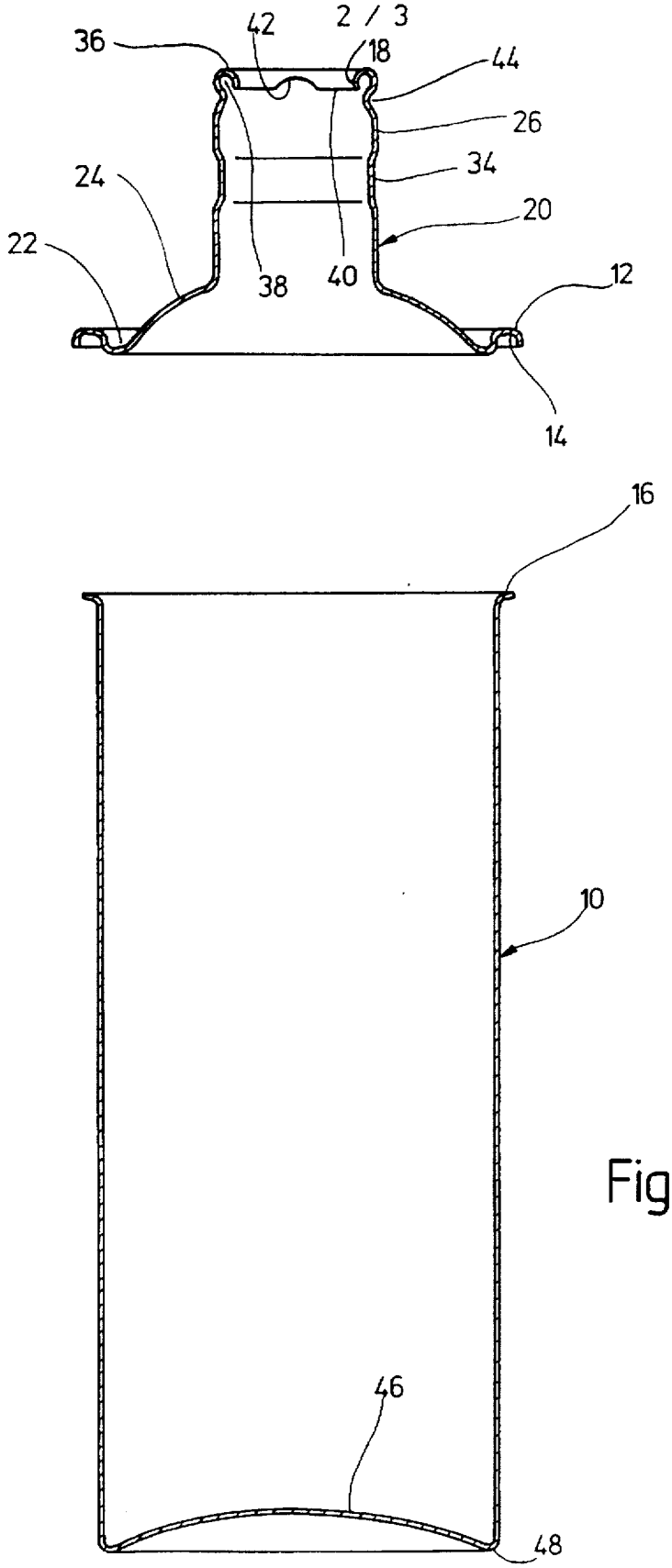
FIG. 2 is a vertical cross section of the cup portion and of the lid portion of the beverage can in an exploded illustration.
Figure 3:
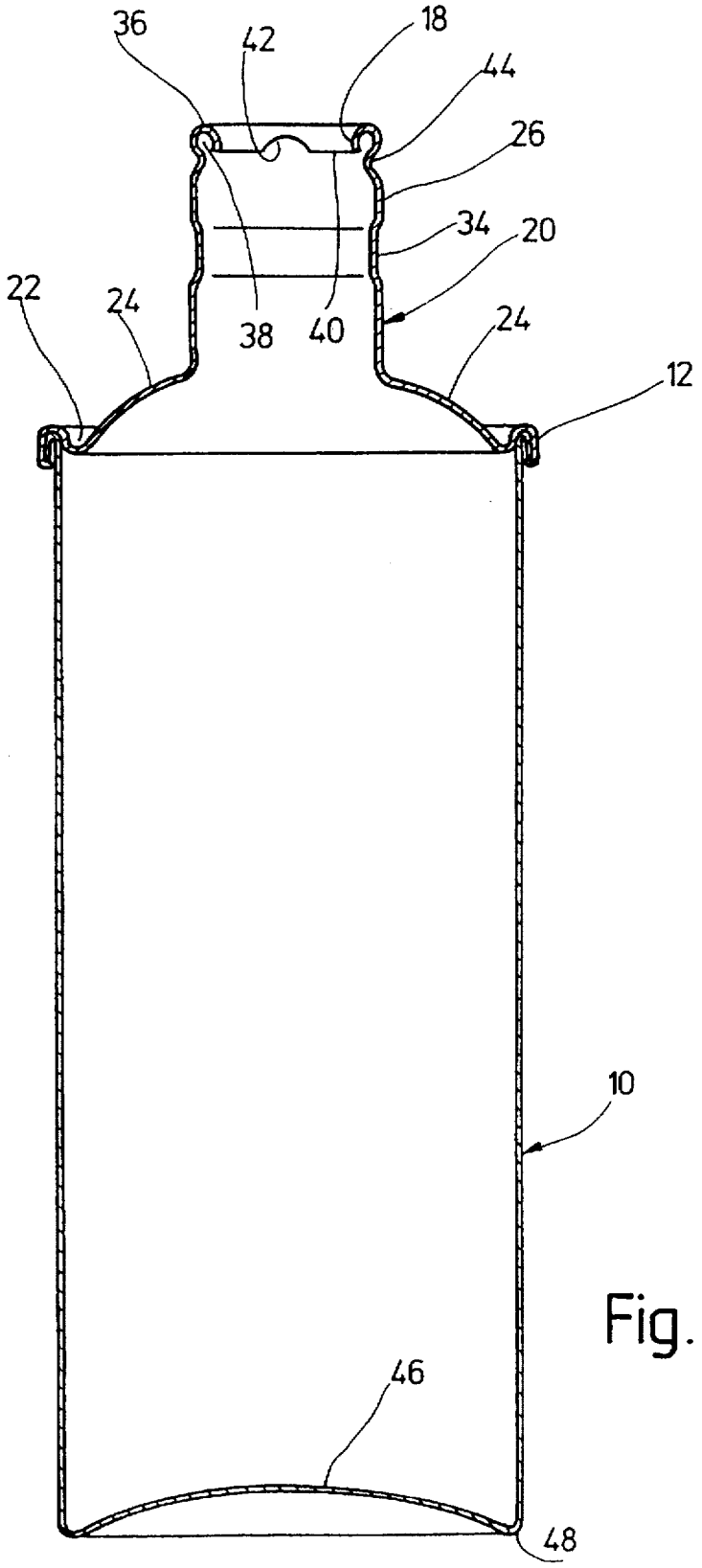
FIG. 3 is a vertical cross section of the cup portion and of the lid portion of the beverage can in an assembled state.

The beverage can illustrated in the drawings consists essentially of a cup portion 10 closed at the bottom end and open at the lid end, and a lid portion 20 having a closable pouring opening 18 and is flanged with a flanged edge 12 onto the lid-facing edge 16 of the cup portion 10 with a circular elastomer gasket 14 clamped between said flanged edge 12 and the lid-facing edge 16. The lid portion 20 has a pouring dome 24 connected on the inside through a circular, upwardly open drop-catching trough 22 to the flanged edge 12 and is convexly upwardly arched beyond the upper edge of the flanged edge 12, which pouring dome has an essentially cylindrical pouring connection 26 projecting axially centrally upwardly and having the pouring opening 18. The pouring opening 18 can be closed off with a crown cork 28 either for transporting and storing purposes or can after the removal of the crown cork again be closed off with a snap closure 30. The snap closure is releasably attached to the pouring connection 26 of the lid portion 20 in the area of a peripheral groove 34 by means of an edge-open resilient support ring 32.

The metal plate of the pouring connection 26 is at its upper edge defining the pouring opening 18 flanged from the outside toward the inside at approximately 180°, thus forming a circular widened pouring edge 36 and an open trough 38 circular toward the inside of the container. The free trough edge 40 pointing toward the inside of the cup has two diametrically oppositely positioned drip release notch 42 open toward the inside of the cup and extend into the vicinity of the upper edge of the pouring edge 36. The notches 42 allow the cleaning and rinsing fluid, which during the cleaning and rinsing operation of the beverage can reaches into the trough 38 when the can is being emptied, can virtually completely escape from the trough.

The pouring connection 26 has a constriction 44 existing at a small distance below the pouring opening 18, which constriction 44 forms an undercut of the pouring edge 36 for mounting the crown cork 28.

The cup portion is preferably manufactured out of an aluminum slug through an extrusion method, whereas the lid portion is constructed as a molded part, deep-drawn in steps and coined forming the pouring opening 18 and the drip release notch 42. To increase the stability, the cup base 46 is curved concavely inwardly from the edge of the base 48.

In conclusion, the following is to be stated: The invention relates to a metal beverage can with a cup portion 10 closed off at the bottom end and is open at the lid end, and a lid portion 20 having a closable pouring opening 18 and is flanged with a flanged edge 12 onto the lid-facing edge 16 of the cup portion with a circular gasket 14 being clamped between the flanged edge 12 and the edge 16 of the cup portion. The lid portion 20 has, according to the invention, a pouring dome 24 connected on the inside through a circular drop-catching trough 22 to the flanged edge 12 and is convexly upwardly arched beyond the upper edge of the flanged edge, and which pouring dome 24 has an axially centrally upwardly projecting, essentially cylindrical pouring connection 26, which has the pouring opening 18.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A metal beverage can comprising a cup portion closed at the bottom and open at a top and a lid portion being seated on the top of the cup portion and having a pouring opening, the cup portion having a lid-facing edge, the lid portion having a flanged edge connected to the lid-facing edge, a gasket being clamped between the flanged edge and the lid-facing edge, the lid portion having a pouring dome including an annular, upwardly open drop-catching trough connected to the flanged edge, the pouring dome being curved convexly upwardly beyond an upper edge of the flanged edge, the pouring dome having an axially centrally upwardly protecting, essentially cylindrical pouring connection defining the pouring opening, and an upper edge region of the pouring connection forming the pouring opening being inwardly rolled through approximately 180° to define an annular trough opening toward the inside of the cup portion and a pouring edge, a free edge of the trough facing toward the inside of the cup portion including at least one drip release notch having an open edge facing toward an inside of the lid portion and oriented adjacent the upper edge of the pouring edge.

2. The beverage can according to claim 1, wherein a constriction is spaced below the pouring opening in the pouring connection annularly undercutting the pouring edge.

3. The beverage can according to claim 1, wherein the pouring connection has a peripheral groove axially spaced from the pouring edge.

4. The beverage can according to claim 1, wherein the cup portion and the lid portion have an inside coating of plastic.

5. The beverage can according to claim 1, wherein the pouring opening is selectively closable with a crown cork and a snap closure.

6. The beverage can according to claim 1, wherein the cup portion has a cup base curved inwardly from a base edge of the cup portion.

7. The beverage can according to claim 3, further comprising an edge-open support ring with diametrically opposed bearing openings for a snap closure releasably locked onto the pouring connection in the area of the peripheral groove.

8. A beverage can comprising a cup portion closed at the bottom and a pouring connection portion connected to an upper end of the cup portion and projecting upwardly beyond the upper end of the cup portion, the pouring connection portion having a closable pouring opening remote from the cup portion, wherein an edge region of a material of the pouring connection portion forming the pouring opening is rolled inwardly of the pouring opening through an angle of generally 180° to form a trough opening toward the cup portion and having an arcuate cross section for the full circumference of the pouring opening, and wherein means defining at least one drip release notch is provided in a wall of the trough facing radially inwardly of the pouring opening, whereby when a liquid beverage contained in the beverage can is emptied therefrom by inverting the beverage can, liquid beverage will pour out of the beverage can through the pouring opening and simultaneously collect in the trough and thence flow from the trough through the drip release notch out through the pouring opening.

9. The beverage can according to claim 8, wherein the pouring connection portion includes a constriction spaced below the pouring opening annularly undercutting the pouring opening and is essentially arcuate in cross section in a plane containing a longitudinal axis of the beverage can.

10. The beverage can according to claim 8, wherein a peripherial groove is positioned on the pouring connection portion at an axial distance from the pouring opening.

11. The beverage can according to claim 10, wherein a base of the cup portion curves inwardly from a peripheral edge of the cup portion.

12. The beverage can according to claim 10, wherein a support ring is provided in the peripheral groove, said support ring having means thereon for effecting a releasable securing of the support ring in the peripheral groove.

13. The beverage can according to claim 12, wherein a snap closure is provided on the support ring for selectively closing the pouring opening.

* * * * *